US012201197B2

(12) United States Patent
Ostasz et al.

(10) Patent No.: US 12,201,197 B2
(45) Date of Patent: Jan. 21, 2025

(54) LOW-PROFILE EXPANDABLE RING STRUCTURE

(71) Applicants: Marek Ostasz, East Rutherford, NJ (US); Dmitriy Klimov, Brooklyn, NY (US)

(72) Inventors: Marek Ostasz, East Rutherford, NJ (US); Dmitriy Klimov, Brooklyn, NY (US)

( * ) Notice: Subject to any disclaimer, the term of this patent is extended or adjusted under 35 U.S.C. 154(b) by 0 days.

(21) Appl. No.: 18/134,026

(22) Filed: Apr. 12, 2023

(65) Prior Publication Data

US 2023/0248125 A1 Aug. 10, 2023

Related U.S. Application Data

(63) Continuation-in-part of application No. 17/347,219, filed on Jun. 14, 2021, now Pat. No. 11,659,902.

(51) Int. Cl.
*A44C 9/02* (2006.01)

(52) U.S. Cl.
CPC ..... *A44C 9/02* (2013.01)

(58) Field of Classification Search
CPC ..... A44C 5/0069; A44C 5/0076; A44C 5/025; A44C 5/04; A44C 5/06; A44C 5/08; A44C 13/00; A44C 9/02; A44C 9/00
See application file for complete search history.

(56) References Cited

U.S. PATENT DOCUMENTS

| | | | | | |
|---|---|---|---|---|---|
| 687,217 | A * | 11/1901 | Fritschle | A44C 5/08 | 132/75.4 |
| 1,515,499 | A * | 11/1924 | Lederer | A44C 11/002 | 63/38 |
| 1,660,438 | A * | 2/1928 | Fielding | A44C 5/08 | 59/79.2 |
| 2,806,363 | A * | 9/1957 | Manne | A44C 9/02 | 63/5.2 |
| 3,017,754 | A * | 1/1962 | Manne | A44C 9/02 | 29/441.1 |
| 10,271,619 | B1 * | 4/2019 | Peck | A44C 5/08 | |
| 10,306,957 | B2 * | 6/2019 | Scandolaro | A44C 5/025 | |
| 11,116,292 | B2 * | 9/2021 | Demeglio | A44C 11/007 | |
| 2016/0345690 | A1 * | 12/2016 | Scandolaro | A44C 5/0076 | |

* cited by examiner

*Primary Examiner* — Jack W Lavinder
(74) *Attorney, Agent, or Firm* — Andrzej Malarz, Esq.

(57) ABSTRACT

A low-profile expandable ring structure comprising a plurality of coupled blocks each maintaining a degree of translational movement with respect to each other. Each block has one or more protruding tubes on the front side, which are inserted into openings of the adjacent block. A tensioned spring is passed through the internal channel of each block, which maintains the ring structure in a closed appearance but allows expansion of the ring structure through the translational movement of the blocks. This nature allows the expandable ring structure to be comfortable for the wearer.

10 Claims, 13 Drawing Sheets

LOW-PROFILE EXPANDABLE RING STRUCTURE

CROSS REFERENCE TO RELATED APPLICATIONS

This application is a continuation-in-part of U.S. patent application Ser. No. 17/347,219, filed Jun. 14, 2021, the content of which is incorporated herein by reference.

FIELD OF INVENTION

The present invention relates to a low-profile expandable ring structure, which is expandable from a minimum size to a maximum size. More specifically, the present invention discloses an expandable ring structure comprising of a plurality of coupled blocks and an internal spring, which allows the structure to expand or contract as needed.

BACKGROUND

Conventional rings are a completely fixed solid structure, and each ring is tailor made to a specific size for the wearer. While this does provide an adequate fit for the wearer, most rings are made to be worn at the base of a given finger. The knuckles of said finger may be larger in circumference than the intended area for the ring; thus, it can be difficult or uncomfortable to put on and vice versa. As a result, the ring may be slightly larger than the finger cross-section and thus would cause it to slide along the finger.

Similarly, most bracelets are rigid and consistently oversized to slip the bracelet over the wrist. While this method works, it causes an issue with a loose bracelet that can slide with ease or even slide through the wrist by accident. Therefore, a need exists for a ring structure that allows the bracelet or ring to conform to the cross section of the wrist or finger.

SUMMARY

A present disclosure provides an expandable ring structure, comprising of a plurality of coupled blocks that each has a degree of translational movement relative to each other. In the main embodiment, each block comprises one or more downward curved tubes extending from the front surface of each block. Further, each curved tube comprises a cutout on the bottom surface for a stopper connection. Each tube has a curved internal channel that extends through an opening in the back surface of each block. The tubes from a block are inserted into the channels of an adjacent block through the rear. A stopper is then coupled beneath each curved tube once a pair of blocks are connected. This is done by "squeezing" the stopper into the curved cutout beneath the bottom surface of the curved tube protrusion. This is done to prevent separation of the blocks. The groove is longer than the stopper thus allowing the translational movement of each relative block. The spring is internal to the tubes and the curved channel through the block. The spring provides a compressive force to maintain a solid-like "closed appearance" unless stretched to accommodate wearer's size. Once taken off, the expandable ring structure reverts to its original size. Application of the curved tube(s) to connect a pair of blocks is novel and unobvious. It provides a strong, durable connection between the pair of adjacent blocks and is easy in manufacture, assembly and is costs effective. Use of the curved tube(s) to connect two adjacent blocks does not require soldering. It constitutes an unique and a simple connection of a pair of adjacent elements of rings and bracelets. Such type of connection can be used not only in jewelry but also in other industries.

DETAILED DESCRIPTION

Figure 1:
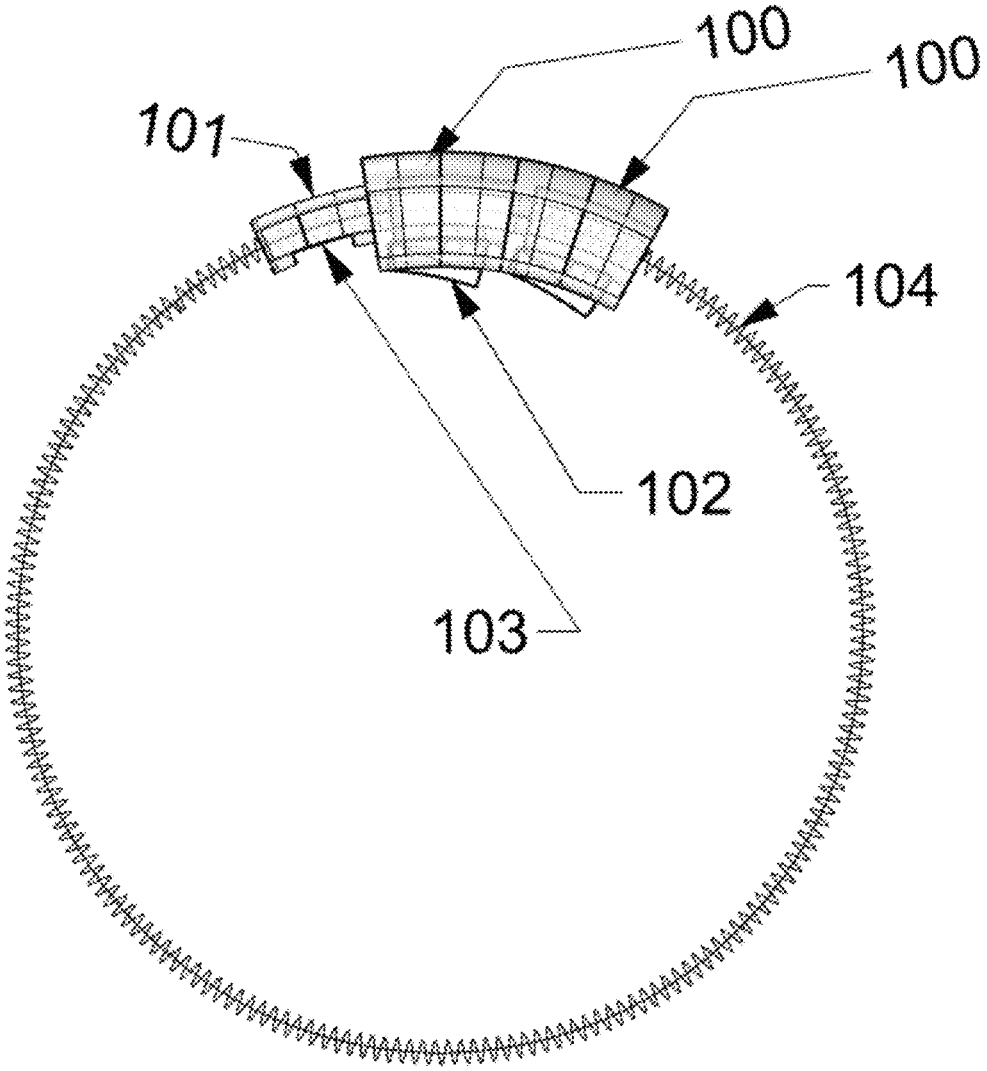
FIG. 1. Depicts a side view of a block of the embodiment of the present solution.

FIGS. 2-5 depict a single block 100 according to the main embodiment of the solution.

Each block generally comprises body 100, tube 101, stopper 102, groove 103, and channel 105.

Each channel is curving downward. Each stopper 102 is shorter than each groove 103 to allow the translational movement of the blocks, which form the low-profile expandable ring structure.

Figure 4:
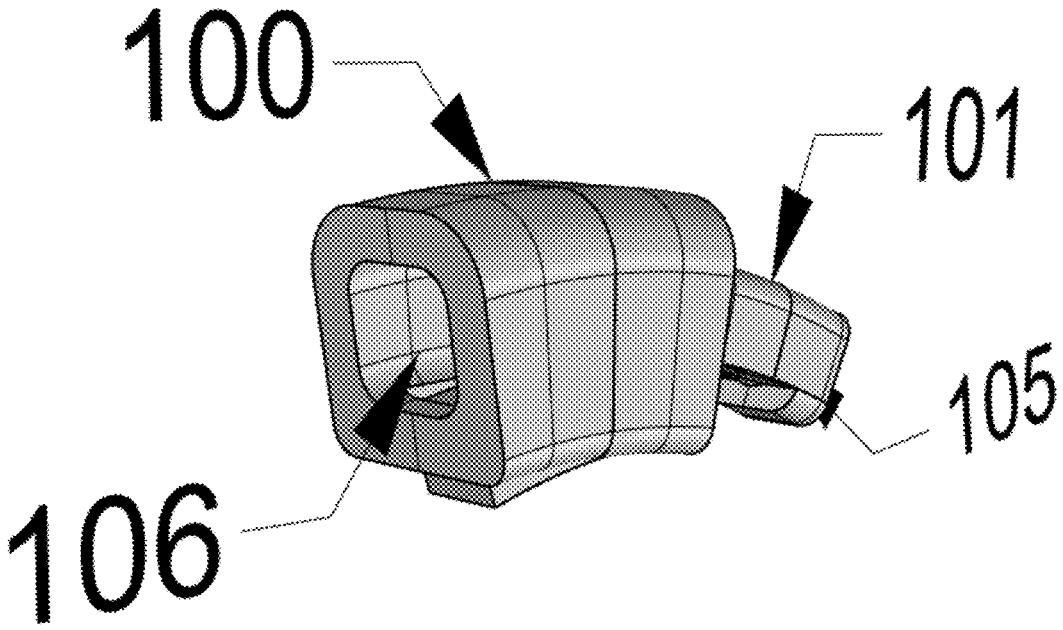
FIG. 4. Depicts a front perspective view of a single block shown in FIG. 1.
Figure 6:
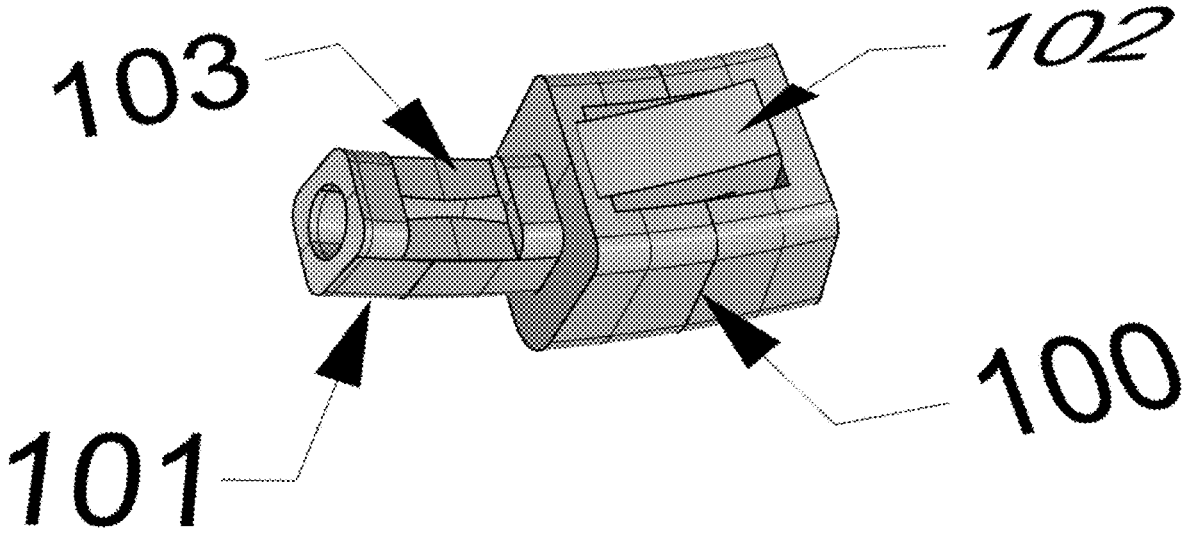
FIG. 6. Depicts the coupling of many blocks with stoppers not inserted.

Body 100 is generally prism shaped with a hollow center to reduce the weight of the body 100 and for ease of manufacturing, according to a preferred embodiment of the invention. As shown in FIG. 4, a bottom surface of body 100 is curved. Thus, when a plurality of blocks is joined together, the plurality forms a smooth ring structure, especially when in the collapsed state, due to the curvature of the bottom surface of body 100. The top surface of body 100 is wider than the bottom surface otherwise sizable gaps, and other internal components, would be visible in the expandable ring structure. The opposing side surfaces of body 100 preferably have the same decoration and construction as depicted in FIGS. 4 and 6.

Figure 2:
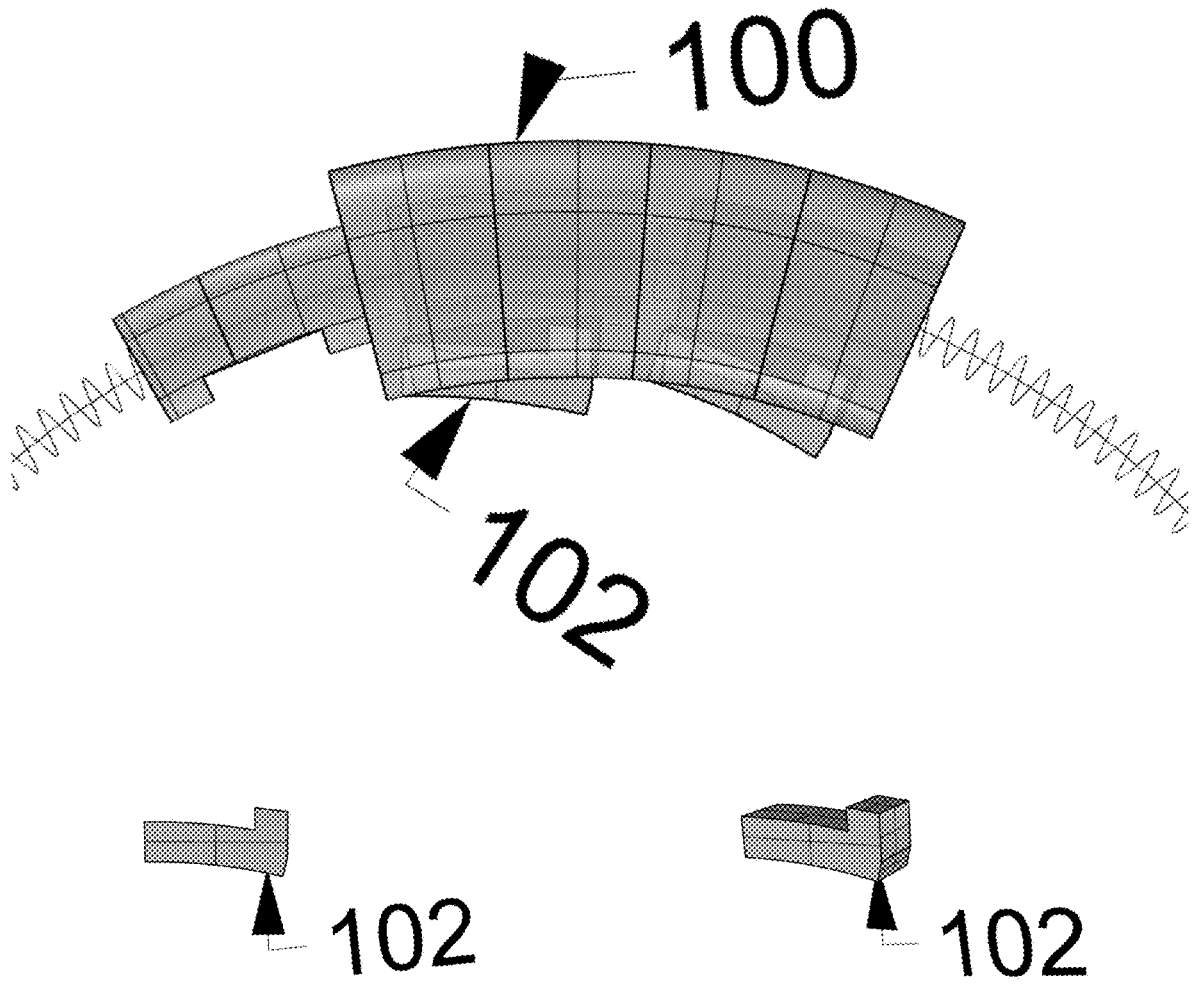
FIG. 2. Depicts a side view and a side perspective view of a single block shown in FIG. 1.
Figure 5:
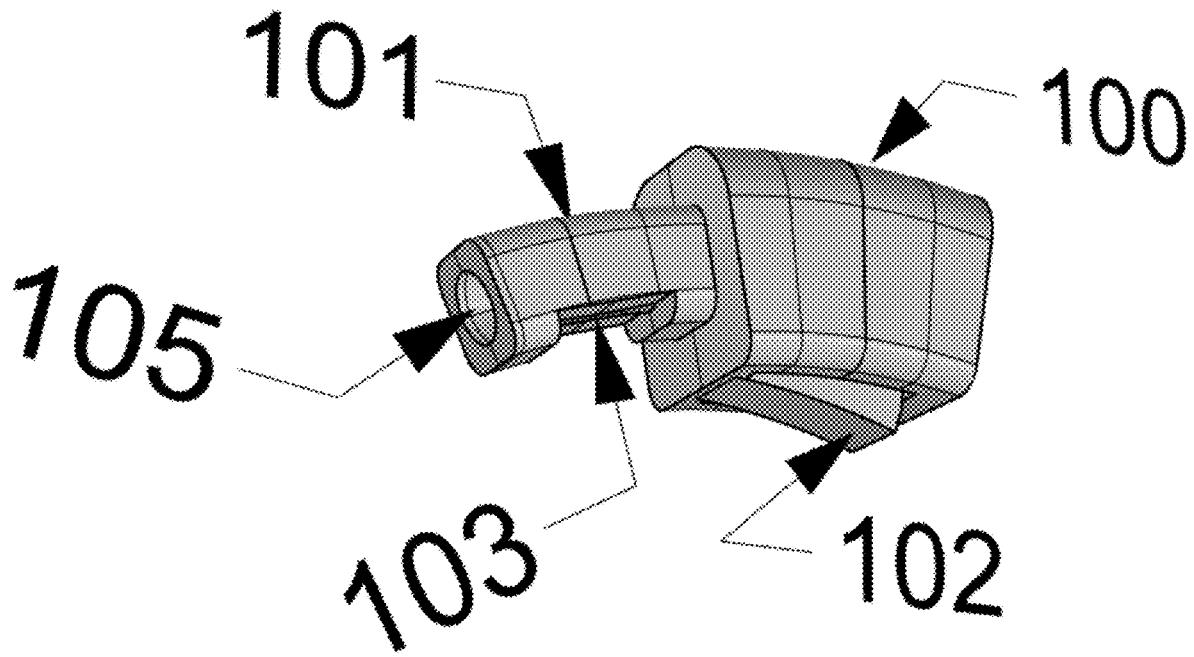
FIG. 5. Depicts a rear left side perspective view of a single block shown in FIG. 1.

In the main embodiment, each block has one or more downward curved tubes 101 extending from the front surface of each block as depicted in FIGS. 1 and 2. Each curved tube 101 has a cutout on the bottom surface for a stopper connection as depicted in FIGS. 5 and 6. Each tube 101 has a curved internal channel that extends through an opening in the back surface of the blocks as depicted in FIGS. 1 and 2.

Figure 7:
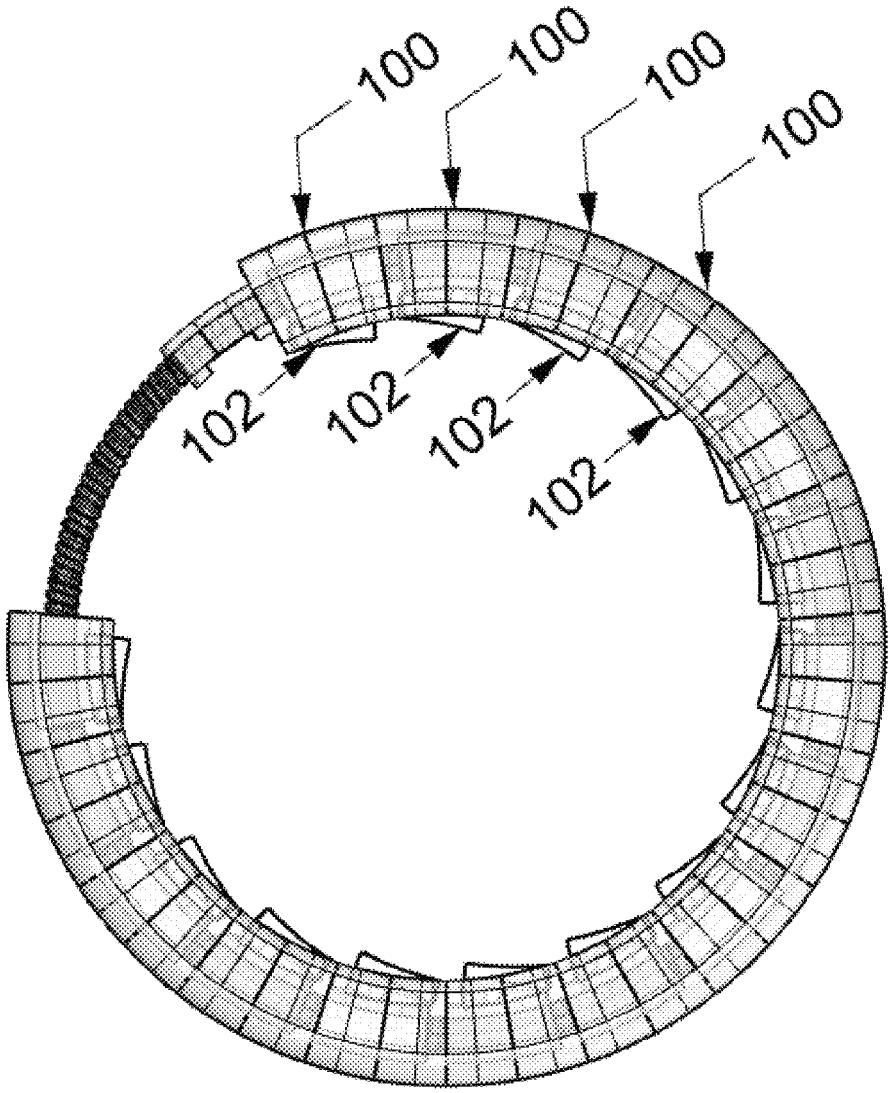
FIG. 7. Depicts the coupling of many blocks with stoppers inserted with complete connections.
Figure 8:
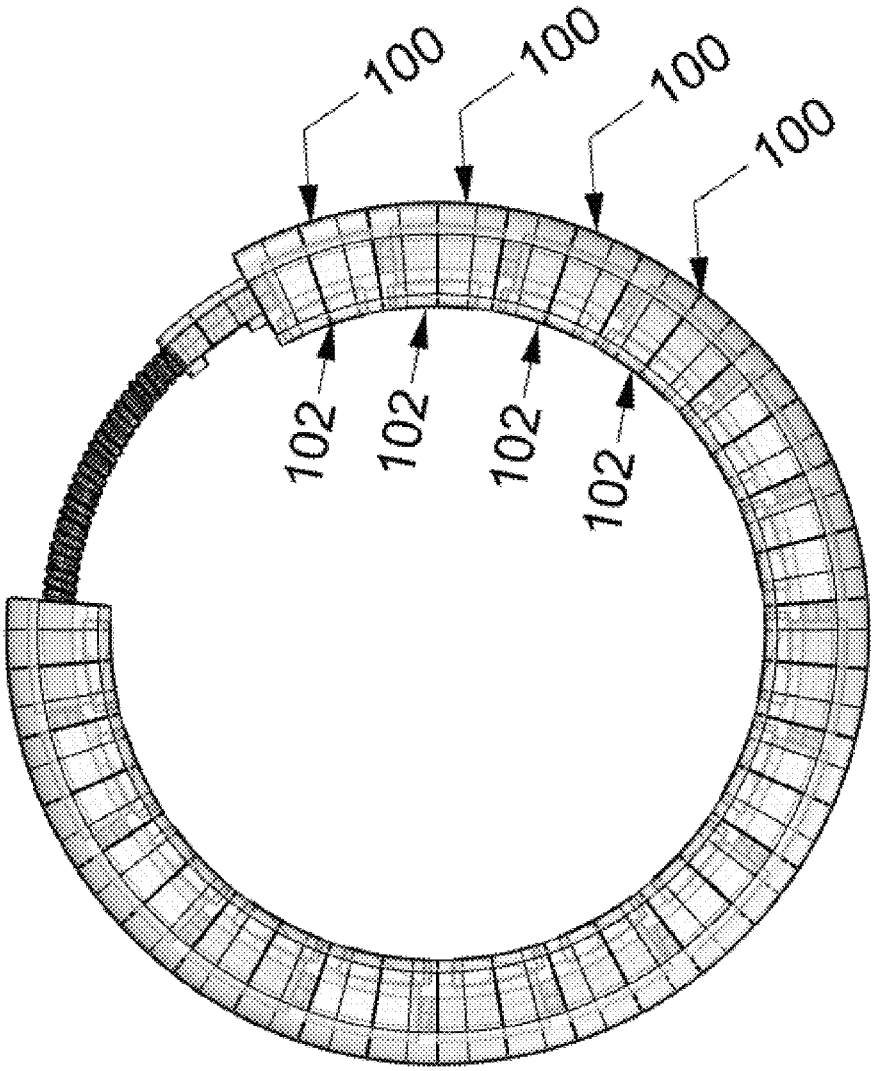
FIG. 8. Depicts full embodiment of the solution.

A stopper 102 is provided in the ring structure that is coupled beneath each curved tube 101 once pairs of blocks are connected as depicted in FIG. 7. This is done by "squeezing" the stopper 102 into the curved cutout, a groove 103, located beneath the bottom surface of the curved tube protrusion as seen in FIG. 8. This is done to prevent separation of the blocks.

FIGS. 7 and 8 show numerous blocks joined together with one spring passing through curved channel 105 of the blocks of the claimed ring structure. FIGS. 7 and 8 also show how the bottom curved surfaces of the blocks form the expandable ring structure and have a smooth curved interior, similar to a standard ring. One or several springs 104 may also be utilized, depending upon the size of expandable ring structure. Application of two or more springs has the advantage that the force from springs 104 is more evenly distributed across the piece.

The groove 103 is longer than the stopper 102 as seen in FIGS. 5 and 6, which is what allows translational movement of each relative block.

Figure 3:
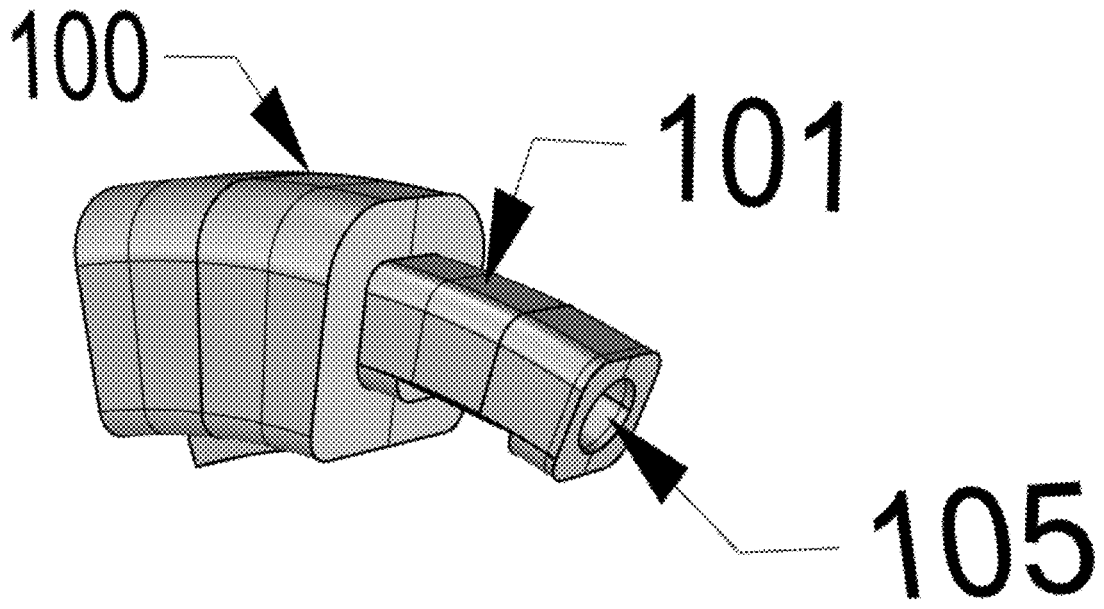
FIG. 3. Depicts a rear right side perspective view of a single block shown in FIG. 1.

A spring 104 is provided in the ring structure, which goes through an opening 105 of the tubes 101 as displayed in FIG. 3. The spring 104 provides a compressive force to maintain a "solid-like" closed appearance unless stretched to accommodate wearer's size. Once taken off, the expandable ring structure reverts to its original size.

FIGS. 7 and 8 depict how adjacent blocks are coupled to each other in the expandable ring structure where a tube 101 from a block is inserted into a channel of an adjacent block through the rear. A stopper 102 is coupled beneath each curved tube 101 once pairs of blocks are connected.

Figure 9:
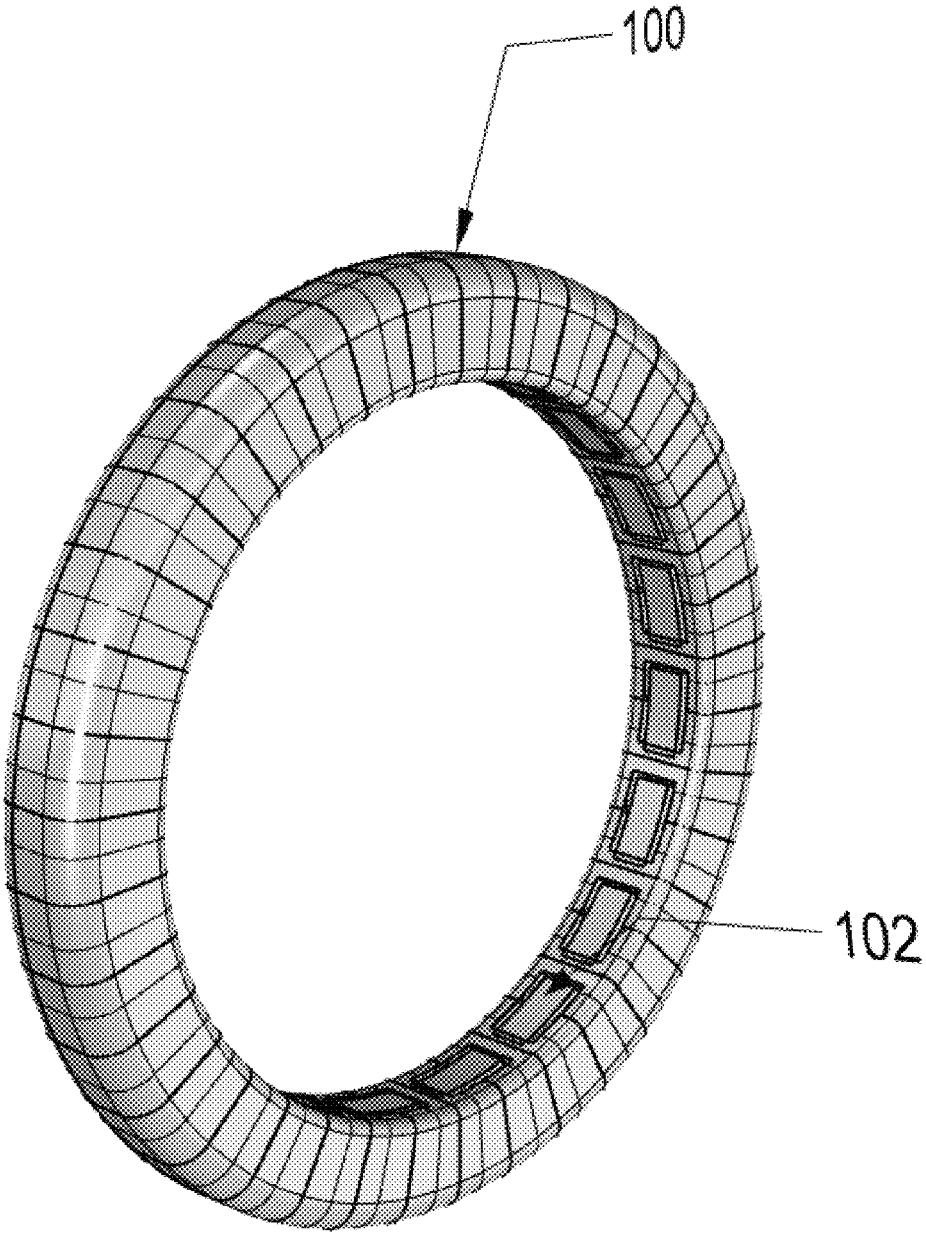
FIG. 9. Depicts an example of singular row of blocks of the solution.

FIG. 9 displays a view of the completed expandable ring structure, according to the preferable embodiment. FIG. 9 shows the low-profile expandable ring structure comprising of a singular row of the blocks and showing the stoppers 102 located on the inner part of a ring.

The internal surface of the claimed expandable ring structure forms a ring and would not feel any different to a user than a standard ring during wear. In fact, the expandable ring structure is more comfortable because it can be adjusted to the user to accommodate swelling, aging, etc. as well as any possible expansion or contraction of the components of the expandable ring structure due to heat, humidity, wear, etc.

To form the claimed expandable ring structure, the following process is preferably utilized. First, all of the blocks, except the first and the last, are joined together using the tubes 101. The tubes 101 from a block are inserted into the channels of an adjacent block through the rear. Then, a stopper 102 is coupled beneath each curved tube once a pair of blocks are connected by "squeezing" the stopper into the curved cutout beneath the bottom surface of the curved tube protrusion. One end of the spring(s) 104 is fixed to the first block, passed through all spring channels, and then stretched and secured to the interior of the last block. The first and last block are then permanently joined together by the tube 101.

Blocks are preferably formed as a unitary piece by casting in a mold. When used for jewelry, the blocks are preferably formed from a precious or semi-precious metal such as silver, gold, platinum, titanium, etc. However, other metals, such as steel, may be used and then provided with a coating or plating of another metal, such as gold.

Figure 10:
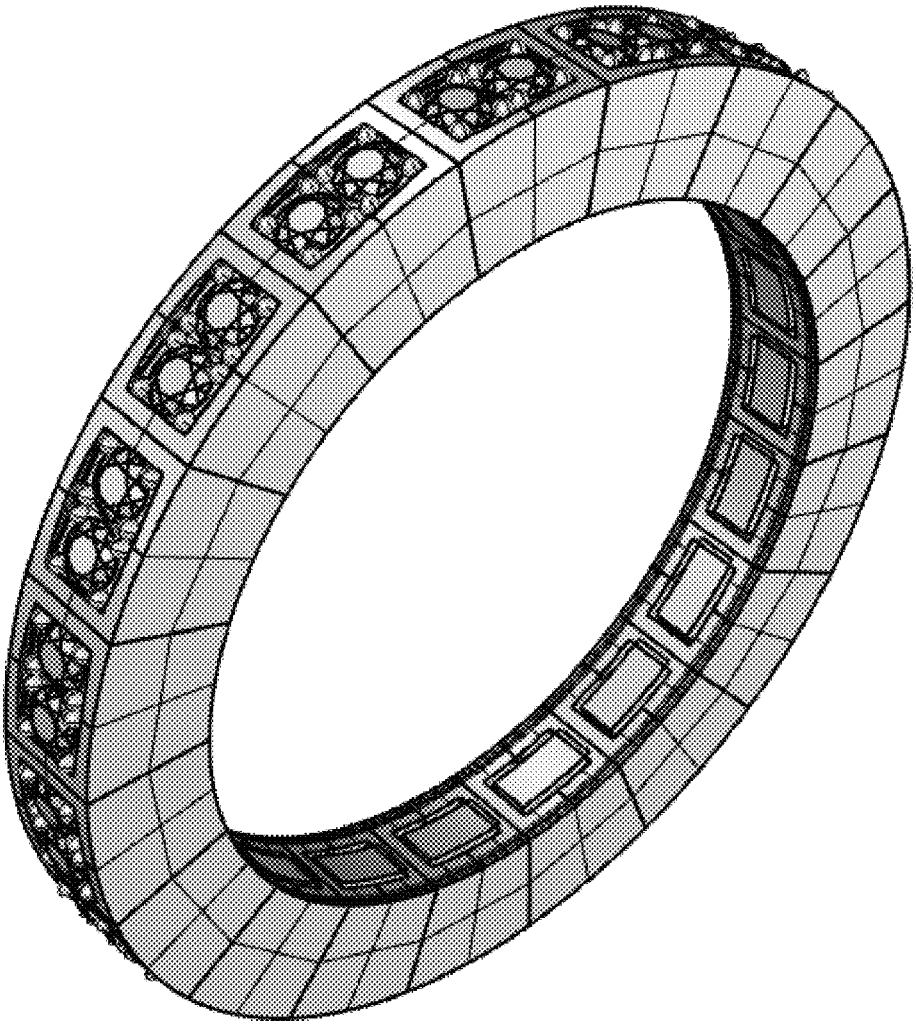
FIG. 10. Depicts an example of double row of blocks of the solution.

FIGS. 3-5 display the opening for the spring 105. FIG. 10 depicts a second embodiment of the blocks of the claimed ring structure comprising of a double row of the blocks, displaying the location of the stoppers 102 on the inner part of the ring. In this embodiment, the size, shape, and curvature of body 100 is the same as those depicted in FIGS. 1-9.

Figure 11:
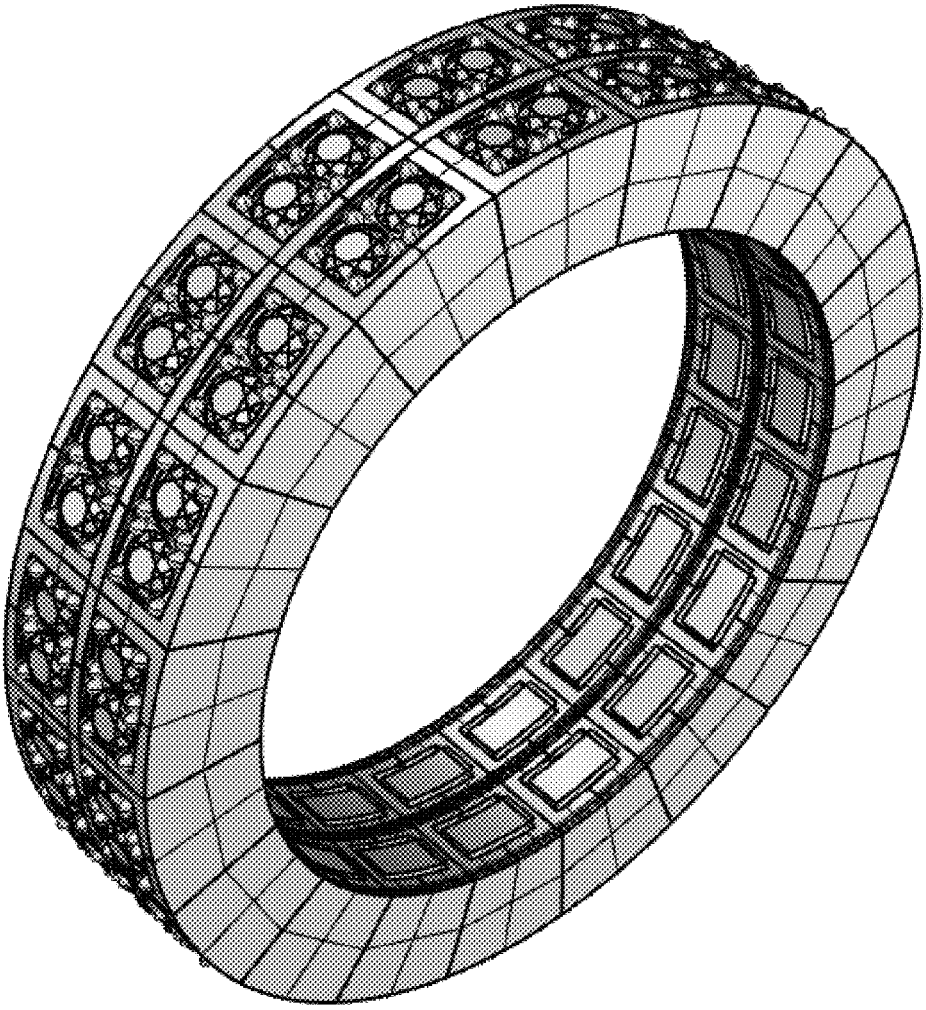
FIG. 11. Depicts an alternate embodiment of the solution shown in FIG. 10.
Figure 12:
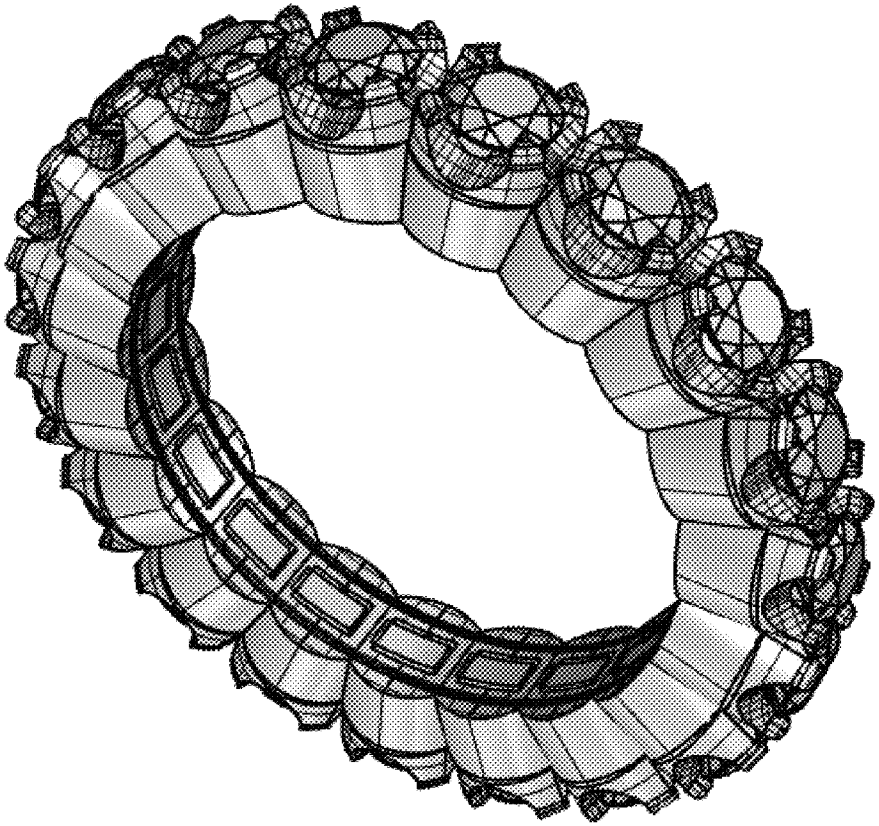
FIG. 12. Depicts an example of multiple rows of blocks of the solution.

Another embodiment of the claimed low-profile expandable ring structure shown in FIG. 10 is displayed in FIG. 11, showing an alternate example of the double row of the blocks in the ring structure with the double row of the stoppers 102. FIG. 12 depicts, in turn, the multiple rows of the blocks of the low-profile expandable ring structure showing location of the stoppers 102.

Figure 13:
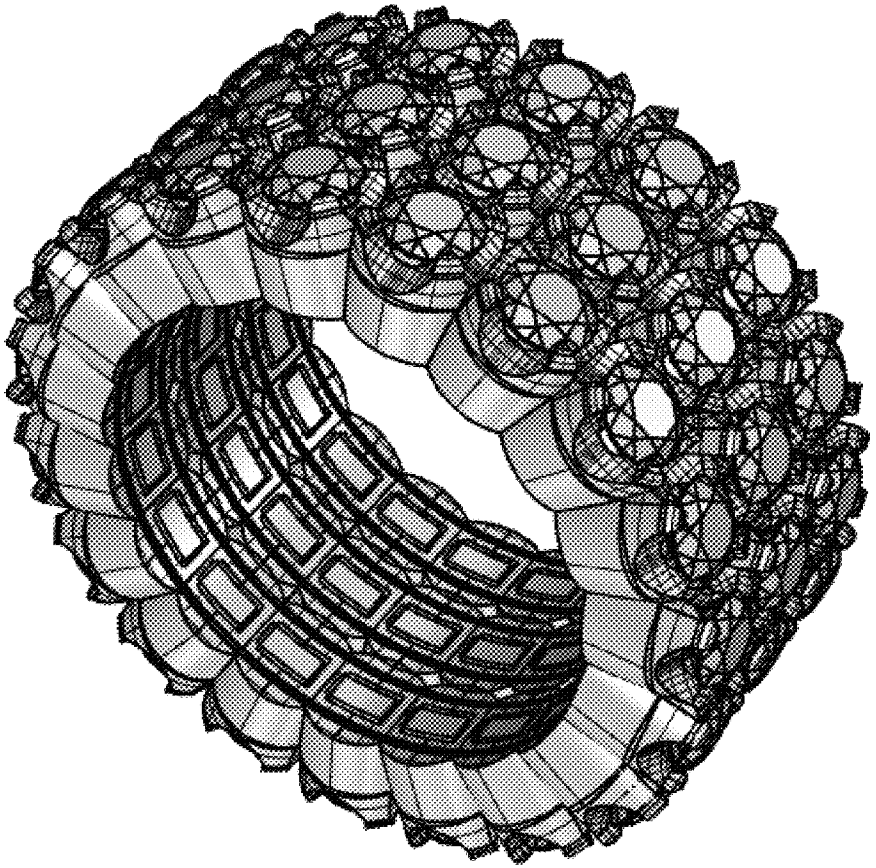
FIG. 13. Depicts an alternate embodiment of the solution shown in FIG. 12.

FIG. 13 displays another embodiment of the low-profile expandable ring, showing the multiple rows of the block and location of the stoppers 102.

The present solution described above is not intended to be limited to any particulars or embodiments or any particular embodiment, but instead it is construed to provide the broadest possible interpretation of claims in view of prior art and, therefore, to effectively provide the possible broadest scope of protection.

REFERENCE NUMERALS

100—body
101—tube
102—stopper
103—groove for stopper
104—spring
105—opening for spring
106—opening for tube

The invention claimed is:

1. An expandable ring structure comprising a plurality of coupled blocks having a degree of translational movement relative to each other, wherein each block comprises:
a body;
one or more downward curved tubes;
a curved channel;
a L-shaped stopper;
a spring; and
a groove, wherein
the groove is a curved cutout with open ends located beneath a bottom surface of each of the one or more downward curved tubes for a stopper connection, wherein
the L-shaped stopper is coupled beneath each of the one or more downward curved tubes inside the body once a pair of blocks is connected by inserting the L-shaped stopper into the curved cutout beneath the bottom surface of the one or more downward tubes to prevent separation of the blocks, wherein
the groove is longer than the L-shaped stopper to allow the translational movement of each block depending on a length of the groove, and wherein the body is prism shaped with a hollow center to reduce the body's weight.

2. The expandable ring structure according to claim 1, wherein the one or more downward curved tubes extend from a front surface of each block.

3. The expandable ring structure according to claim 1, wherein each of the one or more downward curved tubes comprises said curved channel that extends through an opening in a back surface of each block. each of the one or mar downward curved tubes.

4. The expandable ring structure according to claim 1, wherein the one or more downward curved tubes from each block are inserted into a curved internal channel of an adjacent block through an rear.

5. The expandable ring structure according to claim 1, wherein the spring is internal to each of the one or more downward curved tubes and a downwardly curved channel through each block which allows a structure to expand or contract providing a compressive force to maintain a closed appearance unless stretched to accommodate wearer's size.

6. The expandable ring structure according to claim 1, wherein the expandable ring structure is a ring worn on a finger.

7. The expandable ring structure according to claim 1, wherein the expandable ring structure is a bracelet.

8. The expandable ring structure according to claim 1, wherein an interior of the expandable ring structure forms a smooth curved surface.

9. The expandable ring structure according to claim 1, wherein each block is formed from gold, silver, platinum, or titanium.

10. The expandable ring structure according to claim 1, wherein the expandable ring structure reverts to its original size once taken off.

* * * * *